US005540434A

United States Patent [19]

Garrett, Jr. et al.

[11] Patent Number: 5,540,434

[45] Date of Patent: Jul. 30, 1996

[54] TENNIS RACKET

[75] Inventors: Frank Garrett, Jr., Barrington, Ill.; Charles Tricou, State College, Pa.

[73] Assignee: Wilson Sporting Goods Co., Chicago, Ill.

[21] Appl. No.: 569,348

[22] Filed: Aug. 21, 1990

[51] Int. Cl.[6] ..... A63B 49/02

[52] U.S. Cl. ..... 273/73 C; 273/73 G

[58] Field of Search ..... 273/73 R, 73 C, 273/73 D, 73 G

[56] References Cited

U.S. PATENT DOCUMENTS

| | | |
|---|---|---|
| Re. 31,419 | 10/1983 | Frolow . |
| D. 207,322 | 4/1967 | Nuttle, Jr. . |
| D. 233,355 | 10/1974 | Foley . |
| D. 243,467 | 2/1977 | Kouvelas . |
| D. 245,034 | 7/1977 | Segal et al. . |
| D. 246,474 | 11/1977 | Segal et al. . |
| D. 250,905 | 1/1979 | Sawyer . |
| D. 272,553 | 2/1984 | Hall, Jr. et al. . |
| 1,122,159 | 12/1914 | Richey . |
| 1,539,019 | 5/1925 | Nikonow . |
| 2,086,275 | 7/1937 | Lemmon . |
| 2,164,631 | 7/1939 | Abell . |
| 2,171,223 | 8/1939 | Robinson . |
| 3,640,533 | 2/1972 | Davis et al. . |
| 3,647,211 | 3/1972 | Doessel et al. . |
| 3,809,402 | 5/1974 | Haines et al. . |
| 4,070,020 | 1/1978 | Dano . |

(List continued on next page.)

FOREIGN PATENT DOCUMENTS

| | | |
|---|---|---|
| 0171500 | 2/1986 | European Pat. Off. . |
| 0176021 | 4/1986 | European Pat. Off. . |
| 0317711 | 5/1989 | European Pat. Off. . |
| 0340127 | 11/1989 | European Pat. Off. . |
| 827983 | 5/1938 | France . |
| 962312 | 6/1950 | France . |
| 2228245 | 1/1974 | Germany . |
| 0085634 | 7/1978 | Japan . |
| 65851 | 1/1973 | Taiwan . |
| 81346 | 10/1975 | Taiwan . |
| 126369 | 1/1990 | Taiwan . |
| 12146 | of 1911 | United Kingdom . |
| 381673 | 11/1932 | United Kingdom . |
| 415707 | 9/1934 | United Kingdom . |
| 1434741 | 5/1976 | United Kingdom . |
| WO8906558 | 7/1989 | WIPO . |

OTHER PUBLICATIONS

*Profile The Shape Of Things To Come,* 1987, Wilson Sporting Goods Co.

*Fortune, World Tennis, And Forbes Articles On The Hottest Racket,* Nov. 1988.

*Wilson Profile–Special Issue, World Tennis,* Jul. 1988.

Best 1985 Catalog, p. 405. Racket.

Wilson 1987 Catalog, pp. 5, 6 and 19. Racket.

Spalding, Spring & Summer, 1973 Catalog, p. 68, squash rackets.

Sportcraft, 1978, p. 29, squash rackets.

Spalding, 1978, Sports Catalog, p. 13, Speed shaft tennis racket.

Slazenger, Sporting Goods Dealer, p. 4, Aug. 1978.

Best Catalog, 1985–1986, p. 404, No. 22, "Pro Kennex Marty Hogan Comp. Racquetball Racquet".

Sport Craft, 1978, p. 30, No. 13136, "Matador" racquet.

Sporting Goods Dealer, Jul. 1977, back cover, Champion ad for racquetball racquets.

Sporting Goods Dealer, Jun. 1978, p. 37, CM300 racquet.

*Primary Examiner*—V. Millin

*Assistant Examiner*—Raleigh W. Chiu

*Attorney, Agent, or Firm*—Tilton, Fallon, Lungmus & Chestnut

[57] ABSTRACT

A tennis racket includes a one piece integrally molded frame with a handle portion and a pair of beams which extend from the handle portion to the top of the racket. The height and width of each beam varies along the length of the beam. In addition, each beam has a maximum width and height at the bottom of the strung surface proximate the intersection of the beams and a frame cross piece.

10 Claims, 2 Drawing Sheets

U.S. PATENT DOCUMENTS 4,165,071 8/1979 Frolow .
4,275,885 6/1981 Howe .
4,280,699 7/1981 Drake .
4,291,574 9/1981 Frolow .
4,293,129 10/1981 Planakis .
4,322,076 3/1982 Bertram et al. .
4,394,014 7/1983 Balaban .
4,399,992 8/1983 Molitor .
4,436,305 3/1984 Fernandez .
4,438,925 3/1984 Lindstrom .
4,440,392 4/1984 Popplewell .
4,441,713 4/1984 Van Dyck et al. .
4,531,738 7/1985 Mortvedt et al. .
4,561,655 12/1985 Mortvedt .
4,664,380 5/1987 Kuebler .
4,690,405 9/1987 Frolow .
4,693,474 9/1987 Glaessgen et al. .
4,768,786 9/1988 Kuebler .
4,804,183 2/1989 Doran et al. .
4,874,570 10/1989 Haines .
4,911,444 3/1990 Yoneyama .
4,919,438 4/1990 Yoneeyama .
4,997,186 3/1991 Carr ..... 273/73 C
5,062,634 11/1991 Strauch et al. ..... 273/73 R X
5,071,124 12/1991 Davis ..... 273/73 C X
5,076,583 12/1991 Hsu ..... 273/73 C
5,110,125 5/1992 Blanc ..... 273/73 C

TENNIS RACKET

BACKGROUND OF THE INVENTION

1. Field Of The Invention

The present invention relates to a sports racket, and more particularly to a racket for playing such sports as tennis or squash and having a configuration which increases the stiffness of the racket and its playability.

2. Description Of The Prior Art

The force applied by a ball to a strung racket bends the racket primarily along a plane disposed perpendicularly to its strung surface (primary mode bending). As the frame cross-section deviates from the longitudinal axis, the cross-section will have a tendency to twist upon ball impact. This twisting or torsional movement increases as the distance from the longitudinal center line of the racket increases. The bending causes deflection of the racket which reduces the power and accuracy that a player may impart to the ball.

The prior art tennis rackets designed to minimize the bending described above usually include a frame with an increased height. These rackets have increased stiffness in the normal bending mode; but they do not significantly reduce the twisting of the two side frame portions that occur.

The tennis racket of the present invention overcomes the disadvantages of prior rackets. It has a configuration which increases stiffness in the primary mode and resists the torsional deformation of the head of the racket. This increased stiffness provides a more stable and accurate strung surface during impact between a ball and the racket.

SUMMARY OF THE INVENTION

In accordance with one embodiment of the present invention, a racket includes a handle portion, a pair of arm portions, a frame cross piece portion which extends between the arm portions, and a pair of curved stringing portions. The curved stringing portions and the frame cross piece define an oval head or hoop which supports the racket stringing. The racket is symmetric with respect to its longitudinal axis which extends along the middle of the racket. Corresponding arm and stringing portions lie on opposite sides of this longitudinal axis and define a pair of beam portions which meet at the top of the racket.

Each beam has a generally oval cross-section with a longitudinal or major axis and a minor axis. The minor axis lies in the plane of the strung surface; and the major axis extends perpendicularly to it. The height and width of each beam (as measured along the major and minor axis of the beam's cross-section) varies along the length of the beam, beginning with a first predetermined width at the bottom of the beam, tapering outwardly and increasing in size to a maximum width and height proximate the end of the arm portion (proximate to the beam's inflection point), and tapering inwardly and decreasing in size to the top of the racket. Thus, the portion of the beam which receives the greatest twisting moment, i.e., the section proximate to the frame cross piece portion, has an increased width and height which allows the beam to resist twisting.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representation and fragmentary views may, in part, illustrate the embodiment. In certain instances, the disclosure may not include details which are not necessary for an understanding of the present invention.

DETAILED DESCRIPTION OF THE DRAWINGS AND AN EMBODIMENT

Figure 1:
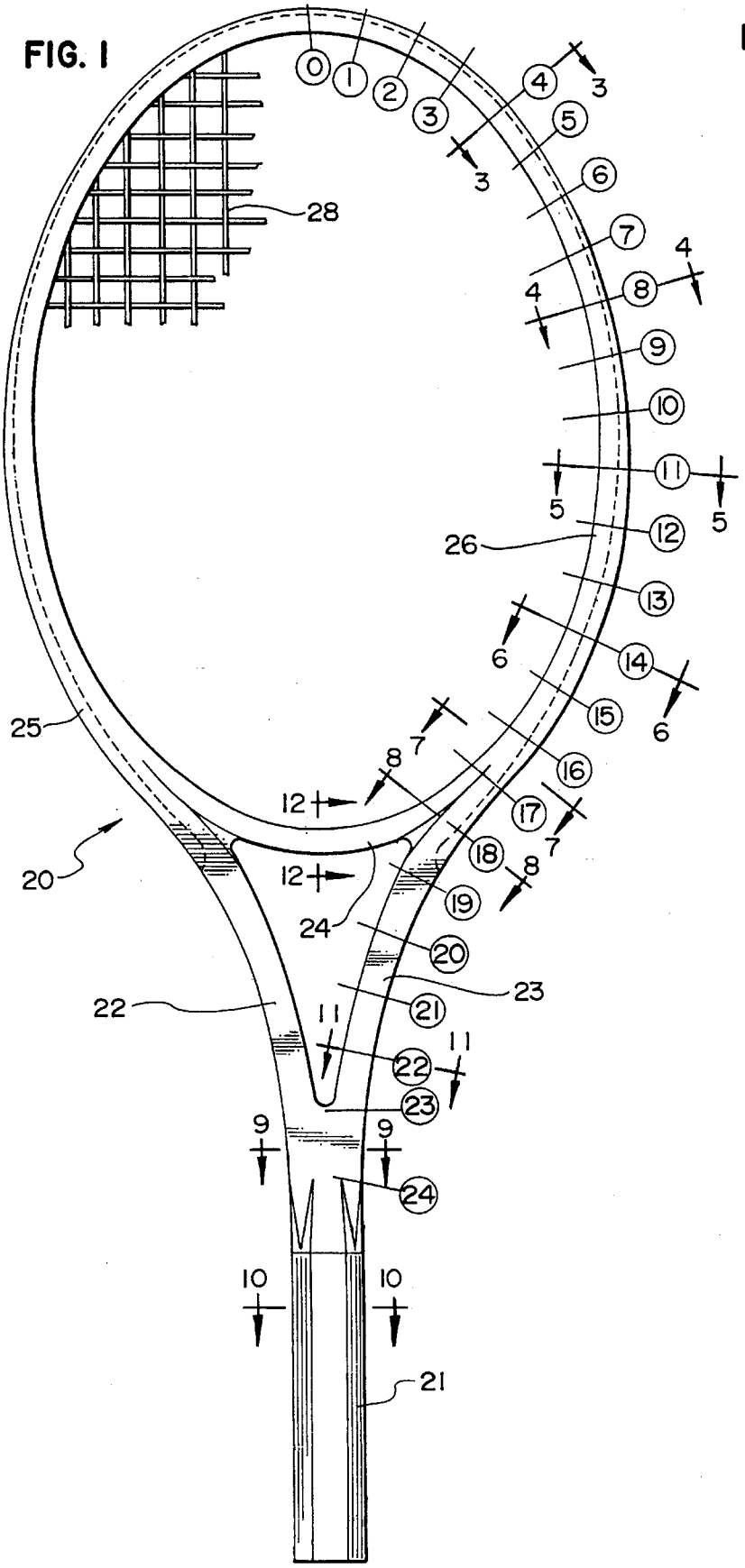
FIG. 1 is a top plan view of the tennis racket of the present invention.

Turning now to the drawings, FIG. 1 shows a tennis racket 20 in accordance with the present invention. The racket 20 includes a frame which is a one piece, integrally molded unit made of graphite and KEVLAR fibers and resin or any other light-weight material of high strength and rigidity. This frame generally includes a handle portion 21, a pair of arm portions 22 and 23, a frame cross piece portion 24 which extends between the arm portions, and a pair of curved stringing portions 25 and 26.

The curved stringing portions 25 and 26 and the frame cross piece portion 24 define an oval head or hoop which supports the racket stringing. Leather wrapping (not shown) or wrapping made from any other suitable material covers a substantial length of the handle portion 21 and allows a player to securely grasp the racket.

Figure 2:
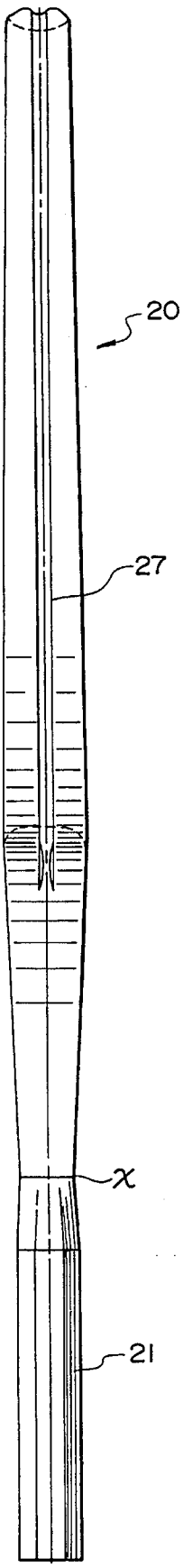
FIG. 2 is a side elevation view of the racket of FIG. 1.
Figure 3:
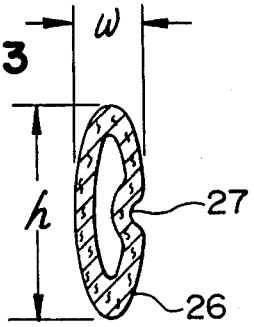
FIG. 3 is a cross sectional view taken along line 3—3 in FIG. 1.
Figure 4:
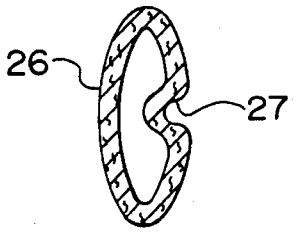
FIG. 4 is a cross sectional view taken along line 4—4 in FIG. 1.
Figure 5:
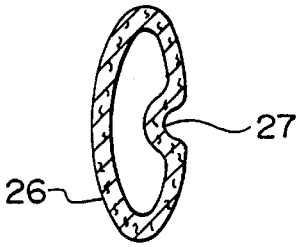
FIG. 5 is a cross sectional view taken along line 5—5 in FIG. 1.
Figure 6:
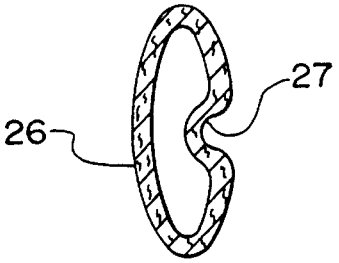
FIG. 6 is a cross sectional view taken along line 6—6 in FIG. 1.
Figure 7:
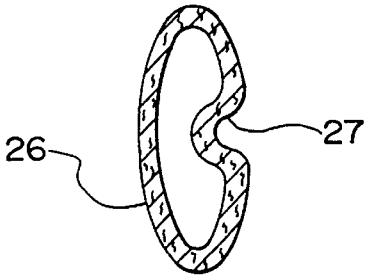
FIG. 7 is a cross sectional view taken along line 7—7 in FIG. 1.
Figure 8:
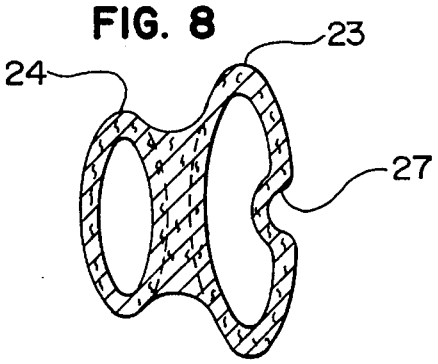
FIG. 8 is a cross sectional view taken along line 8—8 in FIG. 1.
Figure 9:
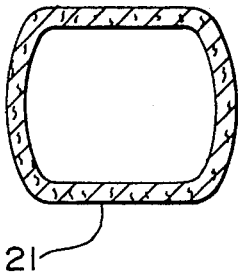
FIG. 9 is a cross sectional view taken along line 9—9 in FIG. 1.
Figure 10:
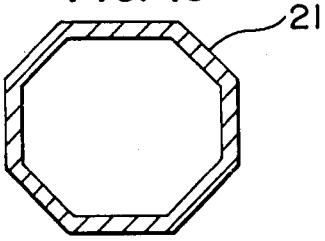
FIG. 10 is a cross sectional view taken along line 10—10 in FIG. 1.
Figure 11:
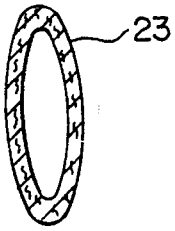
FIG. 11 is a cross-sectional view taken along line 11—11 in FIG. 1.
Figure 12:
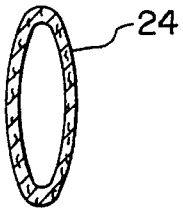
FIG. 12 is a cross sectional view taken along line 12—12 in FIG. 1.

The racket 20 is symmetric with respect to a longitudinal axis which extends along the middle of the racket from the bottom end of the handle portion 21 to the top of the racket. The arm portion 22 and the stringing portion 25 lie on one side of this longitudinal axis and define a first beam portion. The arm portion 23 and the stringing portion 26 lie on the opposite side and define a second beam portion. These beam portions extend from the handle portion 21 (at X, See FIG. 2) and meet at the top of the racket on the racket's longitudinal axis.

Each beam portion has a generally oval cross-section (See FIGS. 3–12) with a longitudinal or major axis and a minor axis. The minor axis extends in the plane of the strung surface; and the major axis lies on a perpendicular to it. The height and width of each beam (as measured along the major and minor axis of the beam's cross-section) vary along the length of the beam, beginning with a first predetermined width at the bottom of the beam, tapering outwardly and increasing in size to a maximum width and height proximate the end of the arm portion (proximate to the beam's inflection point), and tapering inwardly and decreasing in size to the top of the racket 20. Thus, the portion of the beam which receives the greatest twisting moment, i.e., the section proximate to the frame cross piece portion where the frame cross piece portion and an arm portion merge, has an increased width and height which allows the beam to resist twisting.

Each beam portion defines a groove 27 which extends longitudinally of each beam portion on the outward side of the beam. It also defines a plurality of through holes (not shown) spaced apart at predetermined distances. Similarly, the frame cross piece portion 24 defines a plurality of through holes (not shown) spaced apart at predetermined distances. Stringing 28 extends through these holes and along the groove 27 of the beam portions and portion 24 and lies in a predetermined pattern, defining a strung surface.

The racket 20 is a light-weight racket, advantageously within the range of 9.74–10.26 ozs. (276 to 291 grams) (the weights given include 0.49 oz. or 14 grams of string). It has a high center of percussion (disposed proximate the geometric center of the strung surface) and a high center of gravity with the weight distributed according to the teachings of U.S. Pat. No. Re. 31,419 reissued to Frolow on Oct. 18, 1983. The applicants incorporate the disclosure of that patent to the present disclosure by this reference.

The first moment of inertia (torque; first moment=weight× balance point) of the racket 20 is the same as or approximately the first moment of inertia of a conventional racket. Similarly, the second moment of inertia is the same as or approximately that of a conventional racket. In addition, the racket 20 has a small tip deflection (e.g., approximately 0.11 inch as compared to approximately 0.31 inch for a conventional racket).

By way of a specific example, a tennis racket made of graphite and KEVLAR fibers and resin, has an overall length of 26.862 inches and a strung surface with a 10.235 inch width and a 13.60 length. It weighs 9.98 ozs. or 283 grams (this weight includes 0.49 oz. or 14 grams for string); its center of gravity lies approximately 14.76 inches from the bottom end; and its center of percussion lies approximately 19.6 inches from the bottom end. This tennis racket has a first moment of inertia of approximately 10,600 points (283 grams×37.5 cm.) and a second moment of inertia of 2,875–2,975 oz.–in.$^2$.

The following table shows the frame height and frame width (in inches) along the ungrooved outer profile of the frame beginning with position zero at the top of the racket (positions in table shown as numbered circles in FIG. 2):

| Position* | Frame Height (h) | Ungrooved Frame Width (w) |
|---|---|---|
| 0 | 1.080 inches | .420 inches |
| 1 | 1.080 | .420 |
| 2 | 1.105 | .426 |
| 3 | 1.130 | .434 |
| 4 | 1.155 | .445 |
| 5 | 1.180 | .458 |
| 6 | 1.205 | .486 |

-continued

| Position* | Frame Height (h) | Ungrooved Frame Width (w) |
|---|---|---|
| 7 | 1.230 | .509 |
| 8 | 1.255 | .526 |
| 9 | 1.280 | .536 |
| 10 | 1.305 | .540 |
| 11 | 1.330 | .542 |
| 12 | 1.355 | .547 |
| 13 | 1.380 | .557 |
| 14 | 1.405 | .570 |
| 15 | 1.430 | .587 |
| 16 | 1.455 | .607 |
| 17 | 1.480 | — |
| 18 | 1.505 | — |
| 19 | 1.430 | .582 |
| 20 | 1.355 | .566 |
| 21 | 1.280 | .551 |
| 22 | 1.205 | .536 |
| 23 | 1.130 | — |
| 24 | 1.055 | — |

*Cumulative arc length as measured (in inches) along the ungrooved outer profile of the racket frame.

The tip deflection of this racket is 0.11 inch. (Typically, the tip deflection of a conventional racket is approximately 0.31 inch.)

While the above description and the drawings disclose and illustrate one embodiment, it should be understood, of course, that the invention is not limited to this embodiment. Those skilled in the art to which the invention pertains may make modifications and other embodiments employing the principles of this invention, particularly upon considering the foregoing teachings. The applicants intend to cover any such modification and other embodiments which incorporate those features which constitute the essential features of this invention.

What is claimed is:

1. A tennis racket comprising a frame with a handle portion, a pair of curved beam portions which extend along a predetermined path to define an oval head, and a cross piece portion which extends between the beam portions; each beam portion including an arm portion and a stringing portion, the stringing portions and the cross piece portions defining a generally triangular throat; each beam portion extending from the handle portion to the top of the racket and varying in width along its length; each beam portion increasing in width from the handle portion to the cross piece portion, having a maximum width proximate the cross piece portion, and decreasing in width from the cross piece portion to the top of the oval.

2. The tennis racket of claim 1, wherein said frame includes a cross piece portion which extends between the beam portions at the bottom of the oval head, said beam portions having a maximum width adjacent the cross piece portion.

3. The tennis racket of claim 2, wherein each beam varies in height along its length and has a maximum height adjacent the cross piece portion.

4. The tennis racket of claim 3, wherein each of said beams tapers outwardly, increasing in height and width from the handle portion to the cross piece portion and decreasing in height and width from the cross piece portion to the top of the racket.

5. The tennis racket of claim 4, wherein the frame is a one piece integrally molded unit.

6. The tennis racket of claim 5, wherein said frame is made out of graphite and KEVLAR fibers and resin.

7. A tennis racket comprising a frame with a handle portion, a pair of beam portions, and a cross piece portion which extends between said beam portions; each of said beam portions including an arm portion and a stringing portion; the stringing portions of said beam portions and the cross piece portion defining an oval head; the arm portions and the cross piece portion defining a generally triangular throat; each beam portion extending from the handle portion to the top of the racket and varying in width and height along its length; each beam portion increasing in width and height from the handle portion to the cross piece portion, having a maximum width and height adjacent the cross piece portion and decreasing in width and height from the cross piece portion to the top of the oval.

8. The tennis racket of claim 7, wherein each of said beam portions taper outwardly, increasing in height and width from the handle portion to the cross piece portion and decreasing in height and width from the cross piece portion to the top of the racket.

9. The tennis racket of claim 8, wherein the frame is a one piece integrally molded unit.

10. The tennis racket of claim 9, wherein said frame is made out of graphite and KEVLAR fibers and resin.

* * * * *